US007549387B2

(12) United States Patent
Funk

(10) Patent No.: US 7,549,387 B2
(45) Date of Patent: Jun. 23, 2009

(54) SHOCK ABSORBING SEAT PEDESTAL

(76) Inventor: James Joseph Funk, 908 4th Ave. SW., Grand Rapids, MN (US) 55744

( * ) Notice: Subject to any disclaimer, the term of this patent is extended or adjusted under 35 U.S.C. 154(b) by 131 days.

(21) Appl. No.: 11/854,087

(22) Filed: Sep. 12, 2007

(65) Prior Publication Data

US 2009/0064916 A1 Mar. 12, 2009

(51) Int. Cl.

| | |
|---|---|
| ***B63B 17/00*** | (2006.01) |
| ***A47C 3/40*** | (2006.01) |
| ***A47C 7/34*** | (2006.01) |
| ***A47C 7/35*** | (2006.01) |

(52) U.S. Cl. ..... 114/363; 248/565; 248/600; 248/623; 297/344.18

(58) Field of Classification Search ..... 114/363; 297/344.12, 344.18, 344.19; 248/562, 565, 248/599, 600, 616, 623, 188.5
See application file for complete search history.

(56) References Cited

U.S. PATENT DOCUMENTS

| | | | | |
|---|---|---|---|---|
| 5,465,679 | A | 11/1995 | Mardikian | |
| 5,639,059 | A * | 6/1997 | Nash | 248/619 |
| 5,911,191 | A * | 6/1999 | Burer | 114/363 |
| 6,182,590 | B1 | 2/2001 | Patera | |
| 6,880,483 | B2 | 4/2005 | Fedders | |

* cited by examiner

*Primary Examiner*—Ajay Vasudeva
(74) *Attorney, Agent, or Firm*—Weiner & Burt, P.C.; Irving M. Weiner; Pamela S. Burt

(57) ABSTRACT

A shock absorbing boat seat pedestal having two telescoping tubes located between a boat seat and a boat base. Within the tubes is a coil spring mounted over a shock absorber.

2 Claims, 3 Drawing Sheets

SHOCK ABSORBING SEAT PEDESTAL

The present invention relates generally to a shock absorbing boat seat pedestal, and methods of constructing and utilizing same.

More particularly, the present invention relates to a shock absorbing boat seat pedestal which uses a coil spring, a shock absorber, or a coil spring disposed over a shock absorber, and methods of constructing and utilizing same.

BACKGROUND OF THE INVENTION

The relevant art is exemplified by the following U.S. patents:

U.S. Pat. No. 5,465,679 issued in 1995 to Mardikian entitled "PERSONAL WATERCRAFT AND BOAT WITH SHOCK ABSORBING FLOORBOARDS";

U.S. Pat. No. 6,182,590 issued in 2001 to Patera entitled "PERSONAL WATERCRAFT SUSPENSION SYSTEM"; and U.S. Pat. No. 6,880,483 issued in 2005 to Fedders entitled "ACTIVE SEAT SUSPENSION FOR WATERCRAFT".

The desideratum of the present invention is to avoid the animadversions of conventional devices, methods and techniques, and to provide a novel, simple and relatively inexpensive shock absorbing boat seat pedestal which results in a much softer boat ride.

SUMMARY OF THE INVENTION

The present invention provides novel and unique shock absorbing boat seat pedestal comprising, in combination: a pedestal interconnecting a seat in a boat with a seat base near a bottom portion of the boat; said pedestal including outer an inner telescoping components; a first one of said telescoping components being affixed to said boat seat; a second one of said telescoping components being affixed to said seat base near said bottom surface of said boat; shock absorbing means disposed within said telescoping components to absorb impacts created between said boat and waves.

A primary object of the invention is to provide a softer boat ride which minimizes and/or eliminates impacts between the boat and waves.

Other objects, advantages and features of the invention will become apparant to those persons skilled in this particular area of technology and to other persons after having been exposed to the following detailed description when read in conjunction with the accompanying patent drawings.

DETAILED DESCRIPTION OF THE INVENTION

Figure 1:
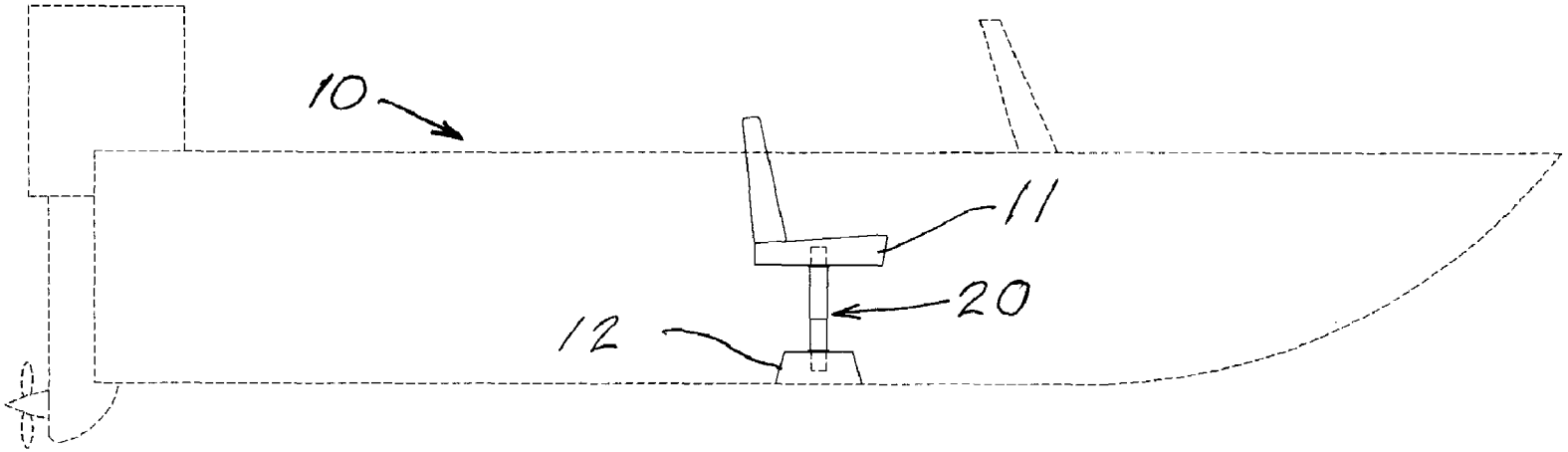
FIG. 1 is a schematic view of a boat provided with a shock absorber boat seat pedestal in accordance with the invention.
Figure 2:
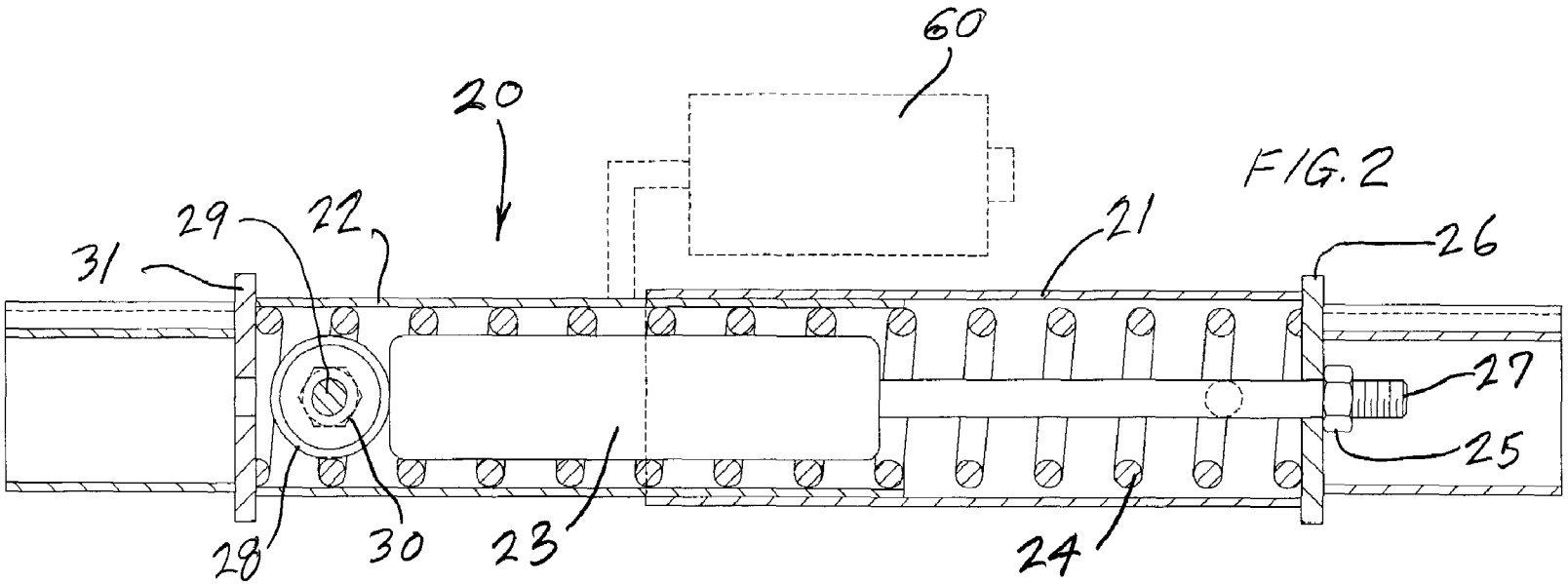
FIG. 2 is cross-sectional view of a first embodiment of the invention including the optional external reservoir.
Figure 3:
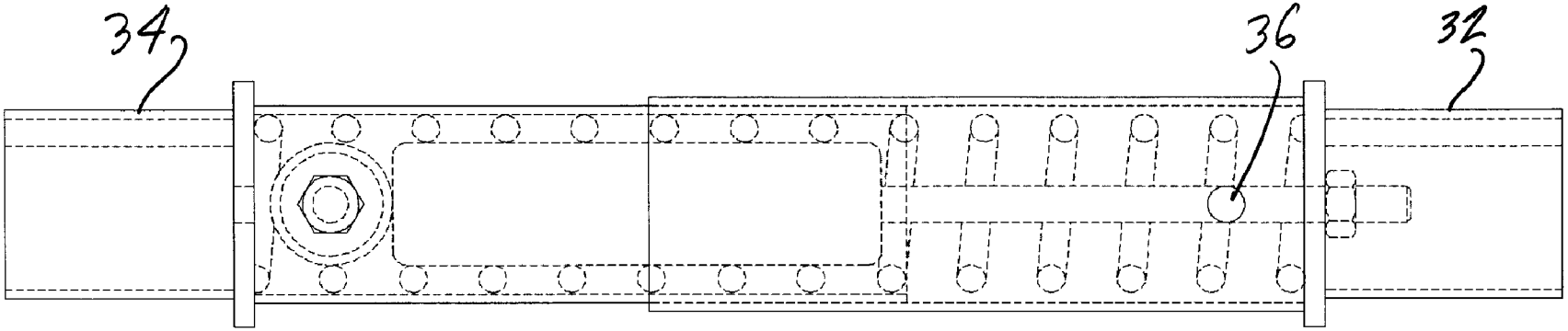
FIG. 3 is an elevational view of the FIG. 2 embodiment in an expanded condition and omitting the external reservoir for clarity.
Figure 4:
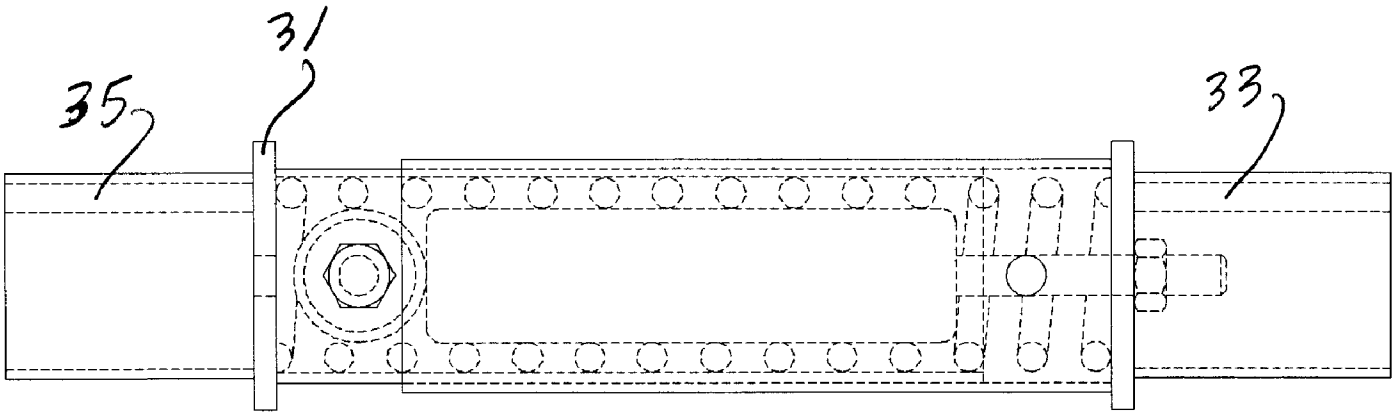
FIG. 4 shows the FIG. 3 embodiment in a compressed condition.
Figure 5:
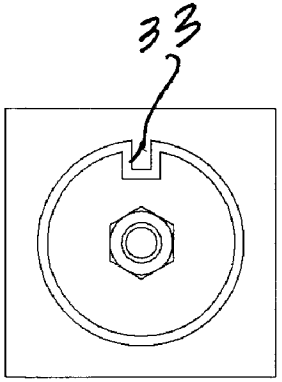
FIG. 5 is an end view of FIG. 4.

With reference to FIG. 1, there is shown a boat 10, a boat seat 11, a boat seat base 12, and a shock absorbing boat seat pedestal 20 in accordance with the invention.

The pedestal 20 is keyed into and bolted to the seat 11 and to the base 12.

Preferably, but not necessarily, the seat 11 and the base 12 may be standard components for current boat construction.

With reference to FIGS. 2-5, there is illustrated shock absorbing boat seat pedestal 20 in accordance with a first embodiment of the invention.

The pedestal 20 includes an outer tubular component 21, an inner tubular component 22, a shock absorber 23, and a coil spring 24.

Tubular components 21 and 22 are constructed, dimensioned and arranged to move telescopically relative to each other.

The components 21 and 22 may be fabricated from any suitable material, such as, for example, aluminum, steel, anodized aluminum, etc.

One end 27 of the shock absorber 23 is affixed to the outer tubular component 21 by means of a threaded nut 25 bearing against flange 26.

The other end 28 of the shock absorber 23 is affixed to the inner tubular component 22 by means of a transverse bolt 29 and mating threaded nut 30.

The coil spring 24 is placed over the shock absorber 23, and is positioned between the flanges 26 and 31 of components 21 and 22, respectively.

Components 21 and 22 are thus held together with the coil spring 24 and shock absorber 23.

The components 21 and 22 move separately of each other through the shock absorber 23/coil spring 24 to absorb any impacts between waves and the boat 10, thus creatin a much smoother/softer ride.

The flange 26 separates the main portion of outer tubular component 21 from an end portion 32 which is provided with an elongated alignment notch or keyway 33.

The keyway 33 slidably joins with a mating part (not shown) of the boat seat 11 to secure the component 21 to the boat seat 11 aided by peripheral bolts (not shown).

The flange 31 separates the main portion of inner tubular component 22 from an end portion 34 which is provided with an elongated alignment notch or keyway 35.

The keyway 35 slidably joins with a mating part (not shown) of the seat base 12 to secure the component 22 to the seat base 12 aided by peripheral bolts (not shown).

Preferably, but not necessarily, the components 21 and 22 may be provided with alternative shock mounting holes 36.

Figure 6:
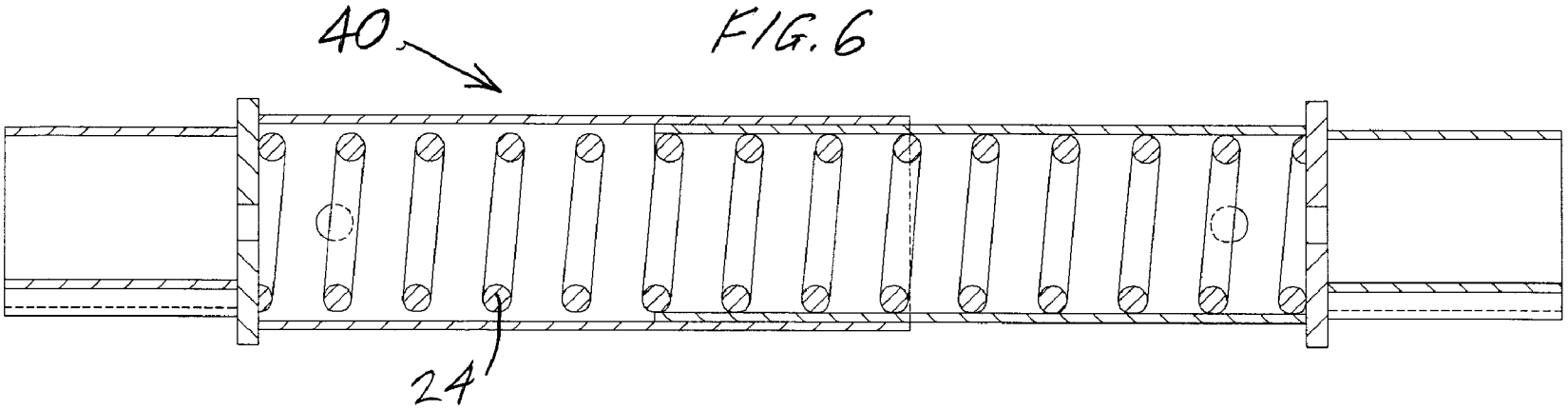
FIG. 6 shows a second embodiment of the invention.

With reference to FIG. 6, there is illustrated a second embodiment in the form of a shock absorbing boat seat pedestal 40.

Pedestal 40 has components similar to the pedestal 20, but the pedestal 40 omits the shock absorber 23.

Figure 7:
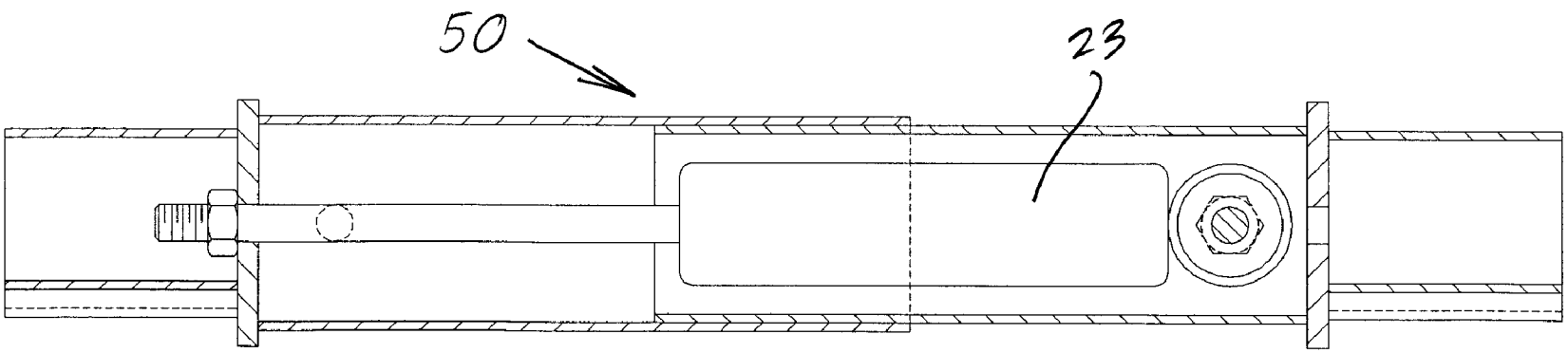
FIG. 7 shows a third embodiment of the invention.

With reference to FIG. 7, there is illustrated a third embodiment in the form of a shock absorbing boat seat pedestal 50.

Pedestal 50 has components similar to the pedestal 20, but the pedestal 50 omits the coil spring 24.

Optionally, the pedestals 20 and 50 may be operatively connected with an external reservoir 60.

The height of the pedestal 20, 40 or 50 is preferably between six inches and sixteen inches.

Although the invention has been described in detail in the foregoing only for the purpose of illustration, it is to be understood that such detail is solely for that purpose and that variations can be made therein by those of ordinary skill in the art without departing from the spirit and scope of the invention as defined by the following claims, including all equivalents thereof.

The invention claimed is:

1. A shock absorbing seat pedestal on a boat comprising:

a substantially vertically disposed pedestal interconnecting a seat in the boat with a seat base near a bottom portion of the boat;

said pedestal including outer and inner telescoping components;

a first one of said telescoping components being affixed to said boat seat, wherein said first one of said telescoping components is provided with a first flange separating a main portion of said first one of said telescoping components from a first end portion of said first one of said telescoping components, and wherein said first end portion of said first one of said telescoping components is provided with an alignment notch for mating with said boat seat;

a second one of said telescoping components being affixed to said seat base near said bottom surface of said boat, wherein said second one of said telescoping components is provided with a second flange separating a main portion of said second one of said telescoping components from a second end portion of said second one of said telescoping components, and wherein said second end portion of said second one of said telescoping components is provided with an alignment notch for mating with said seat base near said bottom surface of said boat; and a shock absorbing mechanism disposed within said telescoping components to absorb impacts created between said boat and waves, wherein said shock absorbing mechanism comprises a coil spring disposed over a shock absorber.

2. The shock absorbing seat pedestal according to claim 1, including: an external reservoir operatively connected to said shock absorber.

* * * * *